United States Patent [19]

Flum

[11] Patent Number: 4,763,796

[45] Date of Patent: Aug. 16, 1988

[54] GRAVITY FEED DISPLAY SYSTEMS AND CONVERSION MEANS FOR OBTAINING SAME

[75] Inventor: Paul L. Flum, Ladue, Mo.

[73] Assignee: Paul Flum Ideas, Inc., St. Louis, Mo.

[21] Appl. No.: 28,661

[22] Filed: Mar. 20, 1987

[51] Int. Cl.[4] ..... A47F 5/00

[52] U.S. Cl. ..... 211/59.2; 108/91; 108/111; 211/186; 211/188

[58] Field of Search ..... 211/188, 153, 126, 186, 211/194, 59.2; 108/91, 111

[56] References Cited

U.S. PATENT DOCUMENTS

| | | | |
|---|---|---|---|
| 4,467,927 | 8/1984 | Nathan | 211/153 |
| 4,531,646 | 7/1985 | Howard | 211/150 |
| 4,550,838 | 11/1985 | Nathan et al. | 211/128 |
| 4,564,111 | 1/1986 | Suttles | 211/189 |
| 4,574,709 | 3/1986 | Lackey et al. | 108/111 |
| 4,593,823 | 6/1986 | Fershko et al. | 211/49.1 |
| 4,593,826 | 6/1986 | Bustos | 211/187 |
| 4,618,115 | 10/1986 | Belokin, Jr. | 248/174 |
| 4,621,740 | 11/1986 | Lang | 211/133 |
| 4,627,542 | 12/1986 | Fredrickson | 211/150 |

*Primary Examiner*—Robert W. Gibson, Jr.
*Attorney, Agent, or Firm*—Haverstock, Garrett & Roberts

[57] ABSTRACT

A modular display unit for vertically stackably arranging products in inclined gravity feed orientation including a plurality of shelf members having a planar floor portion and a plurality of stacking/socket members located at spaced locations adjacent the opposed side portions thereof, the stacking/socket members being arranged in opposed relationship to the floor portion of each of the shelf members and each having a locating surface oriented at the same acute angle relative to the plane of the respective floor portions, a plurality of elongated support members each having opposed end portions adapted to cooperatively engage a respective locating surface associated with the stacking/socket members on adjacent shelf members for connecting the adjacent shelf members in spaced apart relationship, and a plurality of base support members supporting the connected shelf members on a horizontal surface with all of the support members oriented in a vertical direction. Various assemblies for elevating the rear portion of a substantially flat shelf member supported on a substantially flat shelf display area associated with many known modular display units so as to achieve a gravity feed orientation as well as several embodiments of a multi-shelf gravity feed display unit are likewise disclosed herein.

14 Claims, 9 Drawing Sheets

GRAVITY FEED DISPLAY SYSTEMS AND CONVERSION MEANS FOR OBTAINING SAME

The present invention relates generally to product display devices for use in storing and merchandising shelved products and, more particularly, to various gravity feed display systems for continuously maintaining products positioned thereon adjacent the front portion thereof for easy access and removal by customers. Some embodiments of the present invention include a plurality of shelf members and a plurality of elongated support members, the support members each being engageable with any one of a plurality of stacking-/socket means associated with each respective shelf member for stackably arranging the same in spaced relationship one above the other in parallel inclined gravity feed orientation. Other embodiments relate to shelf conversion means and include various constructions for easily converting existing modular display units which include substantially flat horizontal display areas to gravity feed type systems. The present display systems are adaptable for use in many display shelf applications and can be utilized for displaying and merchandising a wide variety of products such as soft drink products, fruit juice products, dairy products, yogurt, beer, liquor and other types of packaged and/or canned products including other types of beverage products. Because of their versatility and capabilities, the present display systems are particularly advantageous for use in supermarkets, convenience stores, grocery outlets, fast food outlets, drug and liquor stores, and a wide variety of other wholesale and retail stores.

BACKGROUND OF THE INVENTION

There exists an ever increasing need and demand for efficient, effective and economical gravity feed display systems which provide maximum flexibility to a merchant in the areas of conserving floor and/or shelf space, minimizing assembly time, and maximizing the storage and display of saleable goods on such assemblies. Many different types of gravity feed devices and systems have been designed and manufactured for use in a multitude of applications for merchandising shelved products to consumers. Such known gravity feed devices teach a wide variety of constructions including modular constructions which permit the vertical stacking of one shelf unit upon the other as well as other types of multi-tiered and multiple shelf constructions. Such known prior art constructions are for the most part characterized by complicated and cumbersome mechanisms which are inconvenient, awkward and difficult to handle and include multiple component parts and complicated support frame structures as well as complicated interconnection means. Many of the known modular type display devices typically support the shelf members or floor display areas associated therewith in a horizontal position only and such units have no capability or adaptability for orienting such shelf or floor areas so as to achieve a gravity feed operation. See for examples the constructions shown in U.S. Pat. Nos. 4,564,111; 4,574,709; 4,593,826; 4,618,115; and 4,621,740. Other known shelving units which afford a gravity feed operation utilize various mechanisms for tilting or inclining the shelf members associated therewith so as to accomplish the same. See for examples the constructions shown in U.S. Pat. Nos. 4,531,646 and 4,627,542. Still other known gravity feed constructions utilize a special bracket design for achieving the multi-tiered gravity feed arrangement such as U.S. Pat. No. 4,593,823 which discloses a two-tier gravity feed system.

Nathan et al U.S. Pat. No. 4,550,838, although disclosing a multi-tiered gravity feed shelf arrangement, likewise suffers from certain disadvantages and shortcomings. For example, the modular display device of Nathan et al utilizes column-like dowels which are engageable with upper and lower recesses located wholly within the side retaining walls associated with each respective shelf member for vertically assembling the respective shelf members in a gravity feed orientation. The size and shape of the upright support members are therefore controlled and limited by the size and shape of the side walls associated with each respective shelf member. The front wall portion of each shelf member associated with the Nathan et al device is specifically designed to include a support edge which lies at an acute angle with the underside portion of each shelf member, which support edge provides a support means for the shelf member when such shelf member is used as the lowermost base shelf member and is disposed in its inclined display position. When assembled, the column-like support dowels are not vertically oriented with respect to the horizontal support surface upon which the overall display unit is positioned, but instead, the support dowels are inclined rearwardly towards the back portion of the unit. This arrangement is not very stable, particularly when a plurality of such shelf members are vertically stackably arranged one above the other, and such an arrangement is also subject to considerable racking. This is not true of the present constructions as will be hereinafter explained. The present shelving units as well as the improved means for vertically stacking such units in spaced relationship one above the other in a gravity feed orientation is clearly different from and distinguishable over the above known prior art constructions including the Nathan et al construction. None of the known gravity feed systems discloses a simple, efficient, and cost effective means for achieving a gravity feed merchandising array whereby the individual shelf members are automatically supported in a stable inclined position. Also, none of the known prior art devices provides means for converting existing modular type display units having a plurality of substantially flat horizontal display areas associated therewith to gravity feed systems as is true of the various shelf conversion means associated with the present invention.

SUMMARY OF THE INVENTION

The present gravity feed display devices overcome many of the disadvantages and shortcomings associated with the known constructions and teach the construction and operation of several embodiments of a display system for gravity feeding products therefrom as well as various alternative means for converting known modular and/or multi-tiered display units into gravity feed systems. One embodiment of the present invention includes a plurality of similar shelf members and a plurality of elongated support members, the support members being cooperatively engageable with stacking-/socket means located adjacent the opposed side wall portions of each respective shelf member. Each socket means includes a pair of counterbores or cavities axially positioned in alignment with each other, each counterbore or cavity being adapted for receiving a correspondingly shaped end portion associated with each support member. Each socket cavity is angularly positioned and located at the same acute angle relative to the plane of each shelf floor portion such that when the elongated support members are engaged therewith and the assembled unit is supported on a substantially horizontal support surface, the floor portion of each individual shelf member will be supported in an inclined gravity feed position. This means that products positioned on each respective shelf member will automatically slide along the floor portion associated respectively therewith towards the front of the unit to provide a convenient, continuous supply of products within easy reach of consumers. The elongated support members are used to arrange and support the respective shelf members in spaced apart relationship one above the other so as to achieve a vertically disposed display system. In this regard, when the support members are properly positioned and engaged with the stacking-/socket means associated with a first shelf member, a second shelf member may be vertically stackably arranged thereupon in position to receive another plurality of support members, if so desired. This stacking process may be continued to achieve any desired number of vertically disposed shelf members and/or any desired display height. An optional base stand or other base means for supporting the entire display array as well as additional reinforcing means may likewise be provided to improve the overall stability and rigidity of the assembled system.

Non-gravity feed type modular display units are also commonly used in supermarkets and other food and beverage outlets to show and focus attention on the merchandising wares displayed therein. Often times additional shelving members are positioned within these modular display units for attractively arranging and organizing the products positioned therewithin for easy access and visibility by the customer. Typically such additional shelving devices are of a one-piece flat construction and are not inclined to provide a gravity feed arrangement. In these situations, it is highly desirable and advantageous for a merchant to be able to convert such display systems to a gravity feed operation because such an arrangement promotes sales. The present invention provides several alternative means for converting such modular display units into gravity feed type systems. Such gravity feed conversion means enables a user to elevate the rear portion of the additional shelf members used in conjunction with such modular display units so as to impart the desired inclination to such additional shelf members for a gravity feed operation.

The present invention further includes several embodiments of a novel design for a non-modular type multi-shelf gravity feed unit which is ideally suited for use as an end-aisle display or other secondary display in a multitude of food and beverage outlets. These embodiments of the present invention are specifically constructed so as to receive and hold many of the known non-gravity feed type shelving devices presently available in the marketplace.

All of the features and capabilities afforded by the presnt devices are particularly important to merchants because they enhance the accessibility to the customer of any products displayed therein and they provide a merchant with a greater range of possibilities for utilizing a gravity feed type arrangement when displaying goods for sale to consumers.

It is therefore a principal object of the present invention to provide an efficient and stable modular type gravity feed display system.

Another object is to provide a simple but effective means for vertically stacking one shelf member above another in a gravity feed orientation.

Another object is to provide a gravity feed display system which reduces the time required to place such systems in a usable condition for accommodating the display and merchandising of goods therefrom.

Another object is to provide a display system which conserves space and is structurally and operationally relatively simple and easy to install and to configure into an operational mode.

Another object is to provide a modular type gravity feed display system which is relatively more stable, durable and able to withstand moderate impact without collapsing and/or disassembling.

Another object is to teach several alternative means for easily converting existing modular display units which include substantially flat horizontal display areas into gravity feed type systems.

Another object is to provide both gravity feed type display systems and gravity feed type shelf conversion means which afford a user several different options when determining how best to display and arrange the sale of a wide variety of products therefrom.

Another object is to provide gravity feed display systems and conversion means for obtaining the same that are structurally and operationally relatively simple, lightweight and inexpensive to manufacture and assembly.

These and other objects and advantages of the present invention will become apparent to those skilled in the art after considering the following detailed specification in conjunction with the accompanying drawings, wherein:

DETAILED DESCRIPTION OF THE INVENTION

Figure 1:
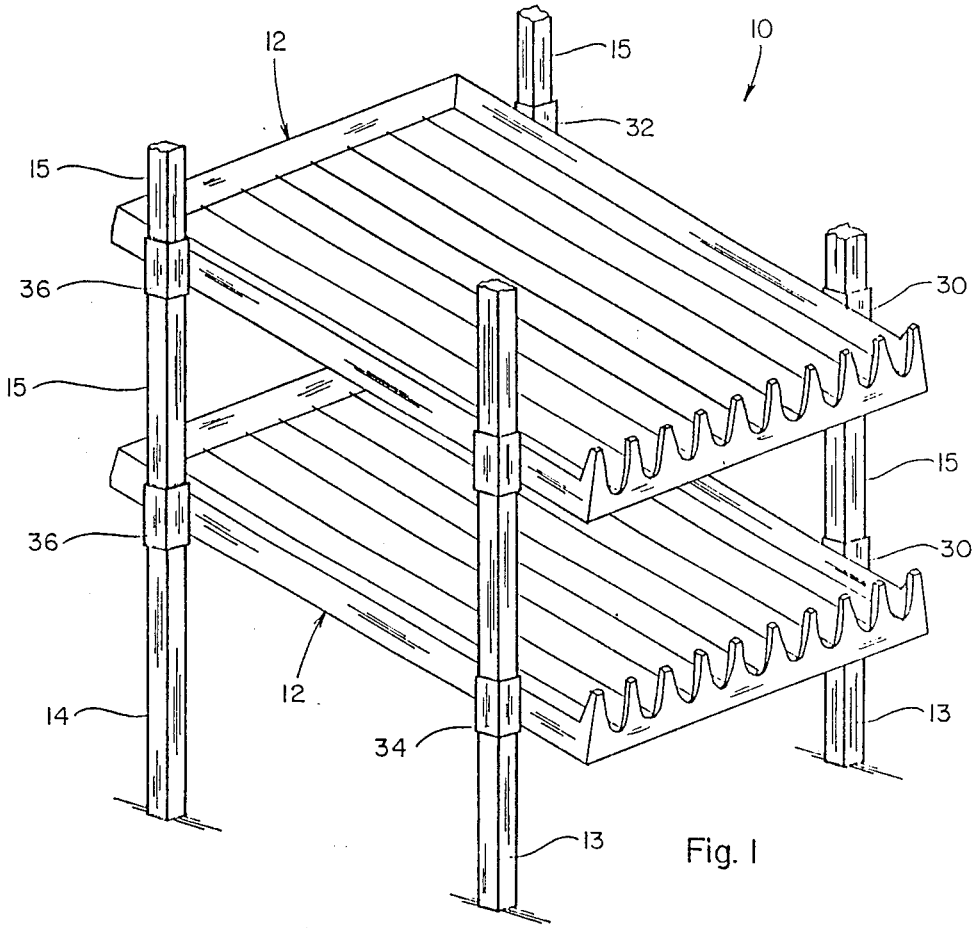
FIG. 1 is a partial perspective view of one embodiment of a gravity feed display system constructed according to the teachings of the present invention.
Figure 2:
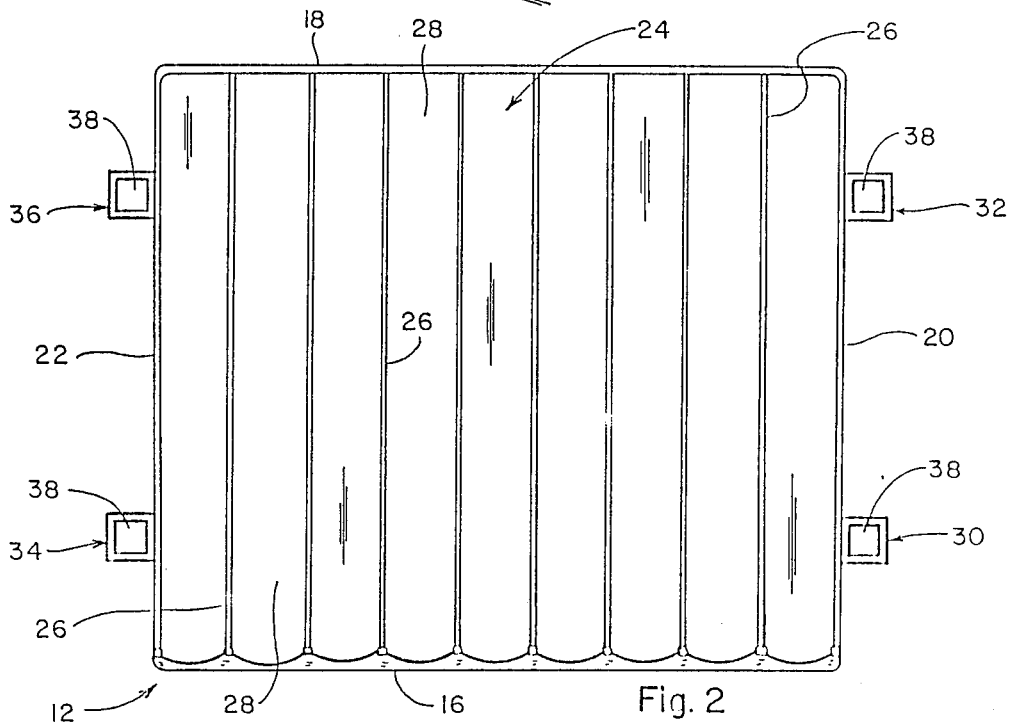
FIG. 2 is a top plan view of one of the shelf members of FIG. 1.

Referring to the drawings more particularly by reference numbers wherein like numerals refer to like parts, number 10 in FIG. 1 identifies a modular type gravity feed display system constructed according to the teachings of the present invention. The display system 10 includes a plurality of substantially similar shelf members 12, a plurality of elongated base support members 13 and 14, and a plurality of elongated support members 15 positioned between the spaced apart shelf members 12 for vertically stacking the same one above the other as shown in FIG. 1. Each of the shelf members 12 is designed to support and merchandise products positioned thereon such as bottled and canned soft drink products and the like, and each shelf 12 includes spaced front and rear wall portions 16 and 18, spaced side wall portions 20 and 22, and a floor portion 24 which extends substantially the full length and width of the member 12 between the front, rear, and side wall portions as shown in FIG. 2. Each shelf member 12 is generally rectangular in shape and may include a plurality of spaced upstanding wall portions or partitions 26 which extend substantially between the front and rear wall portions 16 and 18, the partitions 26 defining therebetween a plurality of parallel guide channels 28 for supporting and guiding products positioned therein in parallel rows. Although use of the partitions 26 enables a merchant to more attractively arrange and organize products positioned within the respective guide channels 28, their use is optional and the shelf members 12 may be constructed with no interior partitions whatsoever. The shelf members 12 may also optionally include one or more track members (not shown) which extend substantially between the front and rear wall portions 16 and 18, the track members acting as a support surface upon which products rest and slide. Typical of such track members are the track members disclosed in U.S. Pat. Nos. 4,454,949 and 4,416,380, both of which patents were issued to the present assignee. Such track members are constructed so as to improve the slidablity of products positioned thereon and their use greatly facilitates a gravity feed operation. It is recognized that the shelf members 12 may be fashioned into a variety of different sizes and shapes, for example, square, circular, hexagonal, or some other configuration, without impairing the teachings of the present invention so long as such members are capable of being stackably arranged in spaced apart relationship one above the other through the use of the support members 13, 14 and 15 as will be hereinafter explained. The shelf members 12 may be of a one-piece construction or they may be comprised of several component sections.

Figure 3:
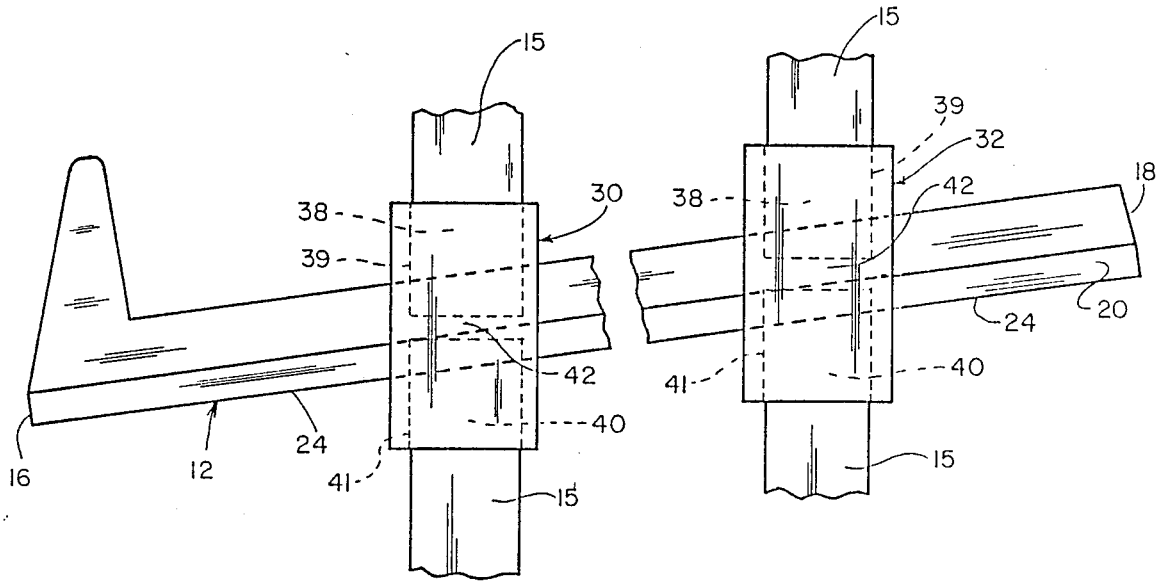
FIG. 3 is a fragmentary side elevational view of the shelf member of FIG. 2 showing the positioning of the socket means adjacent one of the side wall portions thereof.

Stacking means or socket means such as the sockets 30, 32, 34 and 36 are positioned and located adjacent the respective side wall portions of each shelf member 12 as best shown in FIGS. 2 and 3, the sockets 30 and 32 being associated with each side wall portion 20 while the sockets 34 and 36 are associated with each side wall portion 22. Each socket means 30–36 includes a pair of counterbores or cavities 38 and 40 axially positioned in alignment with each other, each cavity 38 and 40 being adapted for receiving and engaging a correspondingly shaped end portion associated with the support members 13–15. Each cavity 38 and 40 includes a side wall portion such as the side wall portions 39 and 41 (FIG. 3) which forms a locating surface for positioning and locating the opposed end portions of the respective support members 13–15 within each such cavity. The cavities 38 and 40 are preferably not sufficiently axially elongated so as to meet, but instead, an intermediate wall portion 42 extends therebetween as best shown in FIG. 3. The wall portion 42 forms a bearing surface for engaging the respective end portions of the support members 13–15 when such members are insertably positioned within the respective cavities 38 and 40 and its thickness can be varied depending upon the weight capacity of the particular goods to be stackably arranged upon the individual shelf members 12. The bearing wall 42 also provides adequate support and stability to the uppermost shelf 12 in any particular array since the support members 15 located immediately therebelow engaged only the lowermost socket cavities 40 associated with such uppermost shelf. Although a single bore extending completely through the respective socket means 30–36 may be utilized to receive and engage the respective end portions associated with the support members 13–15 and such an arrangement will provide suitable results, use of the segregated cavities 38 and 40 with the bearing wall 42 located therebetween adds further support and stability to the overall display system 10. The support members 13–15 are each constructed such that either end portion thereof may be engaged with any one of the respective socket cavities 38 and 40.

The socket cavities 38 and 40 are each respectively angularly positioned at the same acute angle relative to the plane of the floor portion 24 associated with each shelf member 12 such that when such cavities are vertically oriented relative to a horizontal surface, the floor portion 24 of each shelf 12 is angularly oriented as shown in FIGS. 1 and 3 sloping from a more elevated position at the rear of the shelf to a less elevated position at the front thereof. When the support members 13–15 are engaged with their respective socket means 30–36 and the assembled unit 10 is supported on a substantially horizontal support surface as shown in FIG. 1, each individual shelf member 12 will be supported in an inclined gravity feed position. The inclination of the floor 24 is such that when rows of products are positioned thereupon, they will slide under the force of gravity towards the front wall 16 of the members 12 for easy access and removal by customers. As explained in U.S. Pat. Nos. 4,416,380 and 4,454,949, it has been found that a floor or track inclination of between about 7° to 8° provides a desirable condition such that when one of the up-front products is removed, the remaining products positioned therebehind will automatically slide along the respective track members or floor portion in a smooth and steady manner and without toppling over. It has also been found that track or floor inclinations in the range from about 3° to about 11° also provide suitable results for some applications depending upon the particular types of goods being merchandised therefrom. The socket means 30–36 are therefore respectively attached to the respective side wall portions of each shelf member 12 so as to produce the desired angular orientation between the cavity side walls and the plane of the shelf floor as described above.

The socket means 30–36 are preferably tubular in shape and are dimensioned such that the respective openings or cavities 38 and 40 cooperatively or telescopingly receive and engage either end portion of each of the upright support members 13–15 so as to fixedly maintain such support members in an upright substantially vertical position as shown in FIG. 1 when the assembled unit 10 is supported on a substantially horizontal support surface. The socket means 30–36 may be integrally formed with the respective side wall portions of the shelf members 12 or they may be attached thereto as shown in FIG. 3 by any suitable means. Although each of the socket means 30–36 as well as the cavities 38 and 40 associated respectively therewith are shown as being substantially rectangular in shape, it is recognized that the size and shape of both may be fashioned into a variety of different sizes and shapes, for example, triangular, circular, hexigonal, or some other configuration, without impairing the teachings of the present invention so long as the cavities 38 and 40 are adapted to receive and hold the opposite end portions of the support members 13–15. Regardless of their size and/or shape, the cavities 38 and 40 should be of sufficient depth so as to provide stable and rigid stacking of the present shelf members 12 one upon the other depending upon the particular load carrying capacity desired.

Referring to FIG. 1, stackably arranging one shelf member 12 above another in spaced relationship is accomplished by insertably engaging one end portion of the support members 13 and 14 with the respective lower socket cavities 40 located on the first lowermost shelf member 12 and thereafter supporting the members 13 and 14 on a suitable support surface. It is important to note that the support members 13 are engaged with the forwardmost sockets 30 and 34 while the support members 14 are engaged with the rearwardmost sockets 32 and 36 as shown in FIG. 1. Since the support members 14 are greater in length than the members 13 as can be seen from the illustration in FIG. 1, this arrangement will support the first shelf member 12 in an inclined gravity feed position. One end portion of a second set of support members 15 are subsequently insertably engaged with the upper socket cavities 38 of such first shelf member 12 and each extends upwardly therefrom in position to receive the lower socket cavities associated with the next shelf member 12 to be positioned thereabove. Accordingly, the opposite end portions of the support members 15 are respectively engaged with the upper socket cavities 38 associated with one shelf member and the lower socket cavities 40 associated with another shelf member positioned thereabove. This stacking process may be continued to achieve any desired number of vertically disposed shelf members 12 and/or any desired shelf height.

It is important to note that all of the elongated support members 13–15 utilized in the display system 10 are identical in construction to each other except for the base support members 13 and 14 which differ from the members 15 in length only. The rear support members 14 must be greater in length than the front support members 13 in order to achieve the proper inclination of the first shelf member 12 for a gravity feed operation. The difference in overall length between the support members 13 and 14 should be such that when the support members 13 and 14 are engaged with a first shelf member 12 and suppported on a substantially horizontal support surface, such first shelf member 12 is inclined at the desired shelf inclination for a gravity feed operation. The inclination achieved by the differences in length between the members 13 and 14 should be in conformity with the shelf inclinations achieved by the angular positioning of the respective socket means 30–36 associated with each shelf member 12.

The arrangement and positioning of the stacking-/socket means 30–36 is important to the present invention because such arrangement and construction affords several important advantages as compared to known prior art devices. Since the socket means 30–36 are located laterally outwardly relative to the side walls associated with the respective shelf members 12, they do not interfere with or protrude into the usable shelf space and their positioning relative to the shelf side walls provides a more stable support location for the support members 13–15 as the entire load carrying capacity of each shelf member 12 is more evenly distributed to the members 13–15. Also, importantly, when assembled, the support members 13–15 are vertically oriented with respect to the horizontal support surface upon which the overall unit 10 is positioned and such support members are not inclined in any direction relative to such horizontal support surface as is true of some of the known prior art devices such as the Nathan et al construction disclosed in U.S. Pat. No. 4,550,838. The present arrangement of the stacking/socket means 30–36 and the upright support members 13–15 provide a more stable platform, particularly when a plurality of shelf members 12 are vertically stackably arranged one above the other, and such an arrangement is not subject to considerable racking as is true of many of the known prior art devices. The gravity feed display system 10 is structurally and operationally relatively simple and easy to install and to configure into an operational mode and its design and construction reduces the time required to place such a system in a usable condition for accommodating the display and merchandising of goods therefrom.

Figure 4:
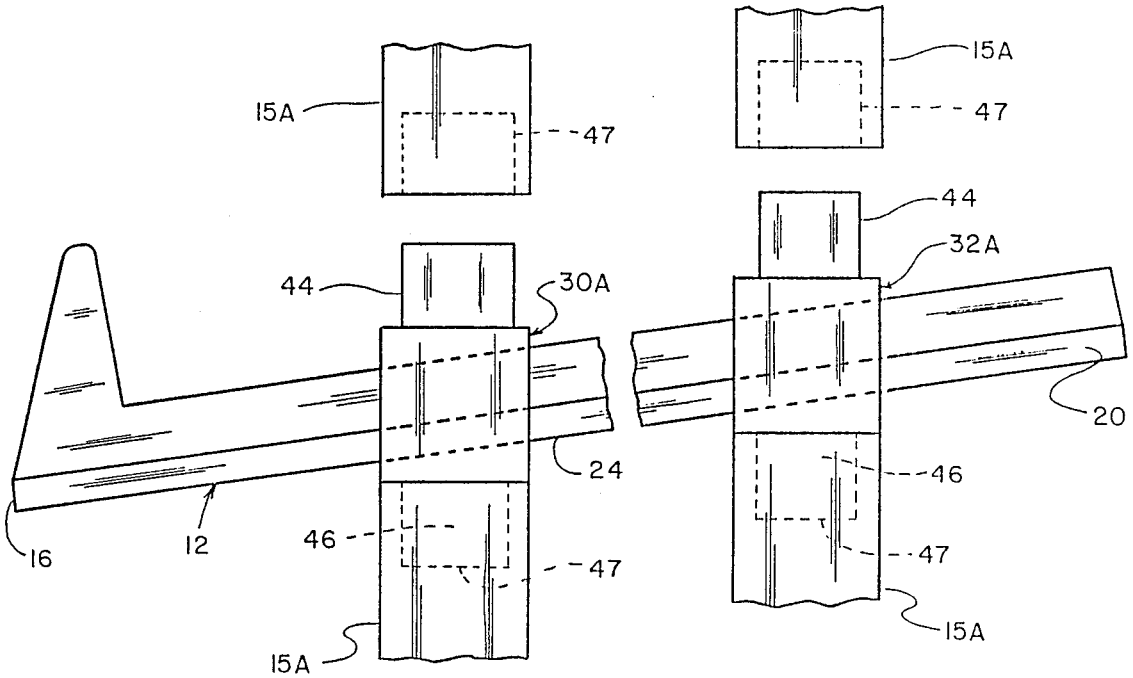
FIG. 4 is a fragmentary partially exploded side elevational view of the shelf member of FIG. 2 showing one embodiment of several stacking members positioned adjacent one of the side wall portions thereof.

It is recognized that various means for cooperatively engaging the opposite end portions of the support members 13–15 to the stacking/socket means 30–36 may be utilized. For example, the respective end portions of the support members 13–15 may be constructed so as to frictionally engage the respective socket cavities 38 and 40 or the respective end portions of the support members 13–15 as well as the socket cavities may include cooperatively engageable threaded means for threadedly engaging the same. It is also recognized that the opposed end portions of the various support members may cooperatively engage or telescope over a projection member or other locating surface associated with each of the opposed ends of the stacking members such as the projection members 44 and 46 associated with the stacking members 30A and 32A shown in FIG. 4. In this situation, the respective end portions of each support member 15A would include an opening or cavity 47 shaped to receive and engage the respective projections 44 and 46. Also, in this particular arrangement, the projections 44 and 46 are each respectively angularly positioned relative to the plane of the floor portion 24 associated with each shelf member 12 such that when the projections are vertically oriented relative to a horizontal surface, the floor portion 24 of each shelf 12 is again angularly oriented in an inclined gravity feed orientation as previously described. In this case, the side wall portions of the projection members 44 and 46 form the locating surface for properly positioning and locating the cavities 47 over the opposed end portions of the respective stacking members. It is further recognized that still other suitable means for cooperatively engaging the respective end portions of the support members with the corresponding stacking/socket means may likewise be utilized. When the unit 10 (FIG. 1) is fully assembled and supported on a substantially horizontal support surface, the support members 13–15 are parallel with respect to each other and are oriented in a substantially vertical direction.

Figure 5:
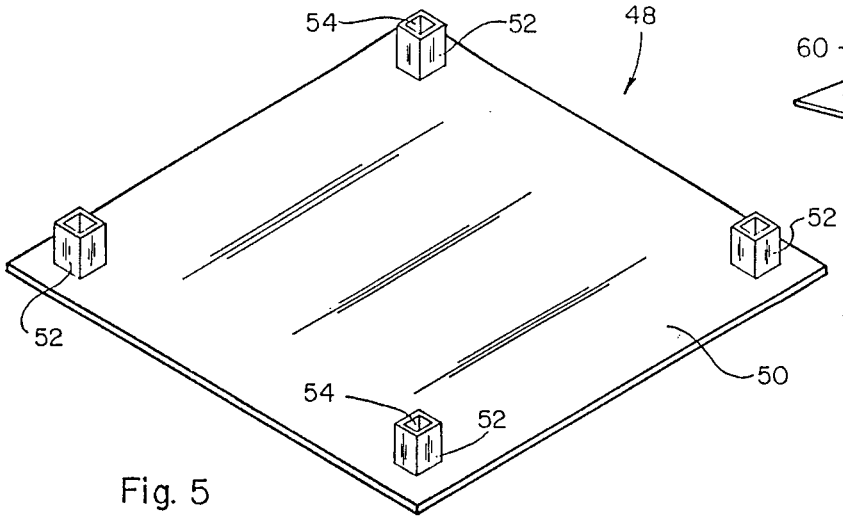
FIG. 5 is a perspective view of one embodiment of an optional base stand member which may be utilized in conjunction with the display system of FIG. 1.
Figure 6:
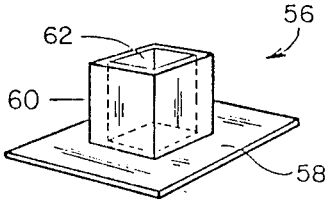
FIG. 6 is a perspective view of another embodiment of an optional base stand member.

An optional base stand or other base means for supporting the base support members 13 and 14 as well as the entire display array may be utilized to improve the overall stability and rigidity of the assembled system. FIGS. 5 and 6 illustrate several embodiments of such optional base means for supporting the entire display array 10. FIG. 5 illustrates a base stand 48 which includes a substantially flat base member 50 having a plurality of receiving means 52 extending upwardly therefrom, the receiving means 52 being positioned and arranged so as to register with the position and location of the base support members 13 and 14 when such members are engaged with the stacking/socket means associated with the first shelf member 12. Like the socket means 30–36, the receiving means 52 each include an opening or cavity 54 formed therewithin adapted for receiving the correspondingly shaped end portions associated with each of the support members 13 and 14. Although the base stand 48 is optional and is not required in the practice of the present invention, when used, the member 48 adds rigidity and stability to the overall display system 10 as it provides a greater bearing surface for supporting the weight of the entire system. Use of the base stand 48 also helps to minimize racking.

FIG. 6 illustrates another optional base stand 56 which is specifically designed to be separately engaged with each individual base support member 13 and 14. The base stand 56 includes a substantially flat base member 58 having a single receiving means 60 extending upwardly therefrom, the receiving means 60 being substantially similar in construction to the receiving means 52 and including an opening or cavity 62 formed therewithin similar to the cavity 54 for receiving either end portion associated with each of the support members 13 and 14. When one of the base stands 56 is engaged with the lower end portion of each base support member 13 and 14, such members provide additional stability and rigidity to the overall system 10 for all of the same reasons previously discussed with respect to use of the base stand 48. It is also recognized that other base means for supporting the entire display array may likewise be utilized to improve the overall stability and rigidity thereof.

Figure 7:
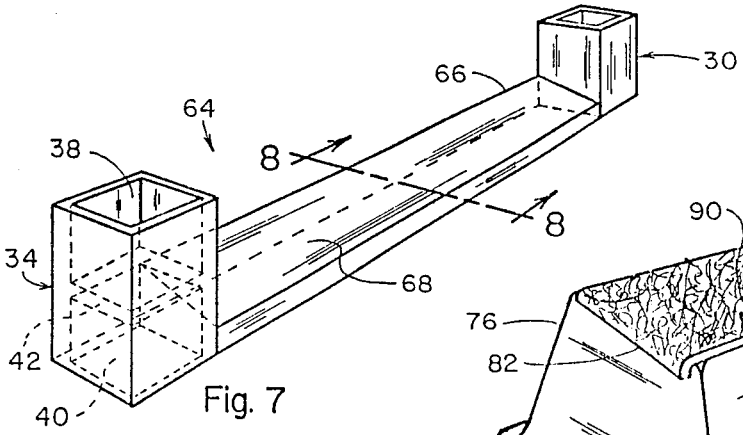
FIG. 7 is a perspective view of an alternative embodiment of the socket means of FIG. 3.
Figure 8:
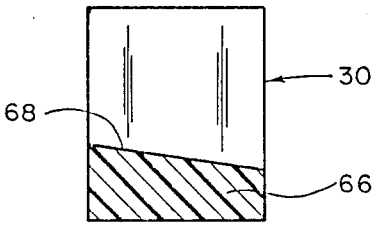
FIG. 8 is a cross-sectional view taken along line 8—8 in FIG. 7.

FIG. 7 illustrates an alternative arrangement 64 of one pair of the opposed socket means shown in FIGS. 1 and 2 such as the forwardmost pair of socket means 30 and 34. The socket arrangement 64 includes an elongated transverse member 66 having one of the previously described socket means attached respectively at each opposite end thereof. The transverse member 66 is designed to extend transversely across the underside portion of the shelf member 12 and is dimensioned to correspond to the transverse dimension of the particular shelf member 12 to which it will be attached. The member 66 includes an upper surface 68 which is forwardly sloped as best shown in FIG. 8, the inclination of the surface 68 corresponding to the desired inclination of the individual shelf members 12 when the display system 10 is fully assembled. Since the surface 68 is forwardly sloped as shown in FIGS. 7 and 8, when the transverse member 66 is fixedly attached to the underside portion of a respective shelf member 12, the socket cavities associated therewith will be angularly oriented relative to the plane of the shelf floor as previously described. The slope of the surface 68 therefore imparts the desired inclination to the shelf member 12 for a gravity feed operation by properly angularly orienting the socket cavities located at each opposite end of the member 66 relative to the shelf floor portion 24. It is understood that in order to obtain the arrangement of the socket means 30–36 as shown in FIG. 2, one embodiment 64 would be attached towards the forward portion of the shelf member 12 and one embodiment 64 would be attached towards the rear thereof. Also, any plurality of the socket arrangement 64 may be attached to a particular shelf member depending upon the size and shape of such shelf member and the weight of the particular goods to be supported thereby. Attachment can be accomplished by any suitable means such as by adhesive means.

Use of the socket arrangement 64 is advantageous because the transverse member 66 associated therewith adds additional strength and support to the shelf member 12 resting thereupon and such member also provides a greater surface area for fixedly attaching the same to the shelf member 12. Besides attaching the shelf member 12 along the entire upper surface 68 of the transverse member 66, the shelf side wall portions may also be attached to the surface of the respective socket means abutting the same thereby providing even further strength and rigidity to the overall arrangement. More importantly, the socket arrangement 64 is particularly advantageous for use with a shelf member which does not include substantial side wall portions for attaching the socket means 30–36 thereto. In this case, the transverse member 66 provides a more than adequate surface for effectively attaching the socket means located at the respective opposite ends thereof to the particular shelf member. It is preferred that the transverse member 66 be integrally formed with the respective socket means associated therewith, although other suitable means for attaching the same may be utilized. It is also recognized that other means for attaching the socket arrangement 64 to a particular shelf as well as other means for achieving the proper angular orientation of the socket cavities relative to the shelf floor may be utilized without departing from the spirit and scope of the present invention.

Although it is recognized that various acceptable materials of construction are available and could equally be employed to construct and fabricate the various components of the display system 10, it is usually preferred that such components be constructed from a plastic material able to withstand moderate impact and mishandling without breakage. It is also recognized that certain metals, metal alloys, fiberglass, or even wood or other materials could be utilized in the practice of this invention but plastics have been found to be preferred. The selection of the material should take into account the type of products and their containers to be merchandised and the environment where the device is to be located. When made from a plastic material, the various components of the display system 10 are suitable for fabrication by either a thermo-forming process or an injection molding process.

Figure 9:
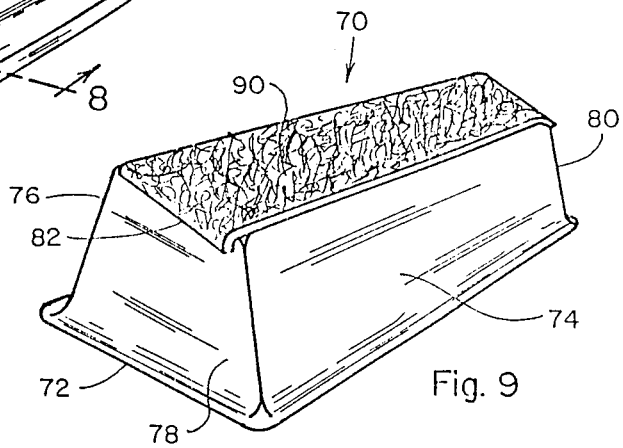
FIG. 9 is a perspective view of a pedestal member which may be used in with non-gravity feed type display units for converting such units to a gravity feed system.
Figure 10:
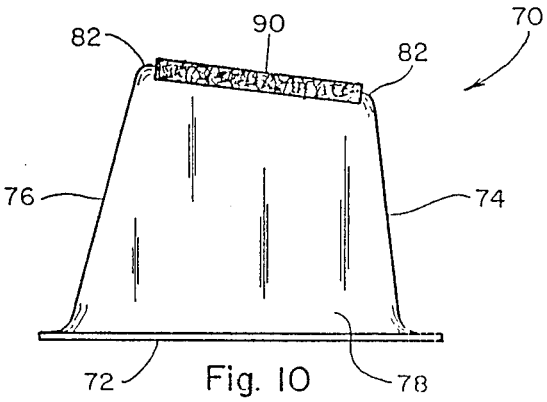
FIG. 10 is a side elevational view of the pedestal member of FIG. 9.

Various means for converting existing modular display units into gravity feed type systems are likewise disclosed herein. Typically, additional shelving members are positioned within the known display units so that the goods displayed thereon can be more attractively arranged and organized for display to potential customers. One means for re-orienting such additional shelf members to a gravity feed orientation includes the use of a pedestal member 70 illustrated in FIGS. 9 and 10. The pedestal member 70 is specifically designed to elevate the rear portion of a substantially flat horizontal shelf member to achieve a gravity feed orientation when such shelf member is utilized in conjunction with the relatively flat shelf display areas associated with many known display units. The pedestal member 70 includes a lower base portion 72 having spaced front and rear walls 74 and 76 and spaced side walls 78 and 80 extending upwardly therefrom forming an upper floor portion 82. The walls 74, 76, 78 and 80 support the floor 82 in an elevated inclined position sloping forwardly from the rear wall 76 towards the front wall 74 as best shown in FIG. 10. The floor 82 is acutely angularly related to the lower base portion 72 (FIGS. 9 and 10).

Figure 11:
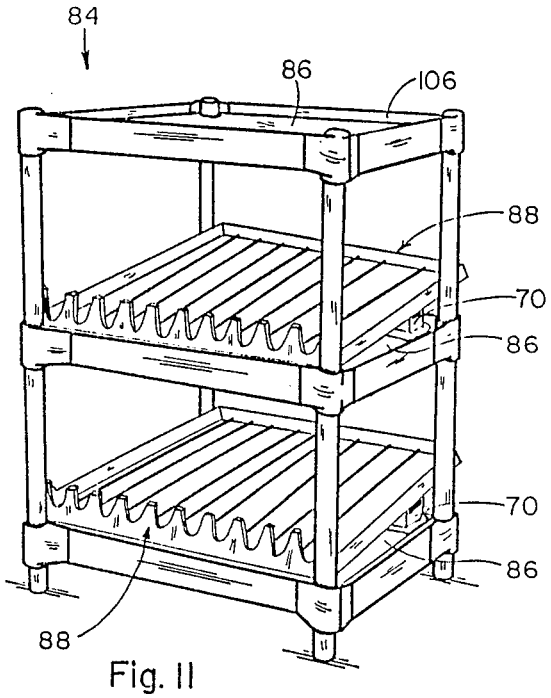
FIG. 11 is a perspective view of a known modular display unit showing use of the pedestal member of FIG. 9 in conjunction with a substantially flat horizontal shelf member for converting said display unit into a gravity feed system.
Figure 12:
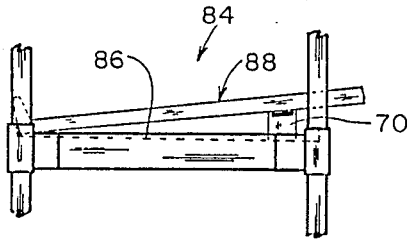
FIG. 12 is a partial side elevational view of the display unit of FIG. 11.

FIGS. 11 and 12 illustrate use of the pedestal member 70 in conjunction with a known non-gravity feed type modular display unit such as the display unit 84. The display unit 84 includes a plurality of substantially flat horizontal shelf display areas 86, each of which areas is adapted for receiving an additional substantially flat horizontal shelf member such as the shelf members 88 shown in FIGS. 11 and 12. When the pedestal member 70 is supported on one of the flat shelf display areas 86 and is properly positioned beneath the rear portion of one of the shelf members 88, the pedestal floor 82 engages the underside rear portion of such shelf and elevates the same so as to impart the desired inclination thereto for a gravity feed type operation. A single elongated pedestal member such as the member 70 illustrated in FIG. 9 or any plurality of shorter pedestal members may be used across the rear portion of the shelf members 88 to adequately support the same in an inclined gravity feed position. As previously discussed, a shelf inclination or slope between about 7° to 8° provides a desirable condition for gravity feed operations although other inclination angles or slopes may likewise provide suitable results for some applications depending upon the nature of the goods being merchandised. The pedestal wall members 74, 76, 78 and 80 are designed and dimensioned so as to achieve the desired pedestal floor inclination. Optional adhesive means, such as the adhesive pad 90, may likewise be utilized on the pedestal floor surface 82 as shown in FIGS. 9 and 10 to further secure the member 70 in proper position relative to the shelf member 88 positioned thereabove. Similarly, optional adhesive means (not shown) may likewise be utilized on the underside portion of the pedestal base 72 to even further secure the member 70 in proper position relative to the shelf display areas 86.

Figure 13:
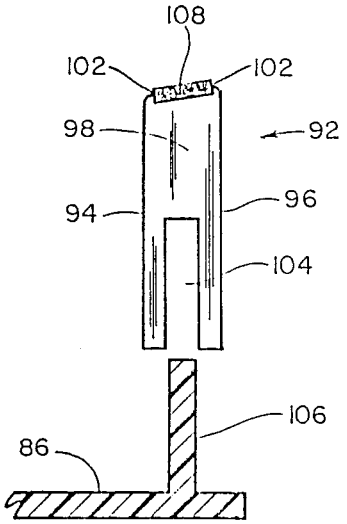
FIG. 13 is an exploded side elevational view of another gravity fee conversion member having means associated therewith for cooperatively engaging the rear wall portion associated with some known display systems.
Figure 14:
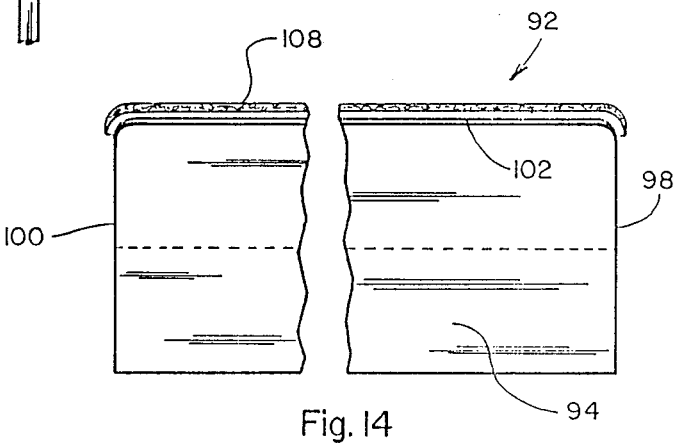
FIG. 14 is a fragmentary front elevational view of the gravity feed conversion member of FIG. 13.

Another means for elevating the rear portion of a substantially flat shelf member used in conjunction with a known display unit includes the use of a bar type member such as the member 92 illustrated in FIGS. 13 and 14. The bar member 92 includes spaced front and rear walls 94 and 96, spaced side walls 98 and 100, an upper floor portion 102 extending therebetween, and means associated with the lower portion thereof for cooperatively engaging the rear wall portion associated with many of the known display systems such as the rear wall 106 associated with the display unit 84 illustrated in FIG. 11. Such cooperatively engageable means may include an elongated slot such as the slot 104 (FIG. 13) which extends the full length of the bar member 92 and is dimensioned so as to frictionally engage the upwardly extending rear wall 106 as shown in FIG. 13. The bar member 92 is vertically dimensioned such that, when engaged with the rear wall 106, the vertical height of such member imparts the desired inclination to the shelf member resting thereupon. In addition, the wall members 94, 96, 98 and 100 may likewise support the upper floor portion 102 in an elevated inclined position sloping forwardly from the rear wall 96 towards the front wall 94 as shown in FIG. 13. The inclined floor 102 should be designed to mate flush with the lower surface of the shelf member positioned thereabove and such inclination should correspond to the desired inclination to be imparted to such shelf member for a gravity feed operation. Any number of bar members 92 including a single elongated bar member may be used across the rear wall 106 to adequately support the self member positioned thereon. Similarly, an optional adhesive pad 108 may also be utilized on the floor surface 102 (FIGS. 13 and 14) to further secure the member 92 in proper position with respect to the shelf member positioned thereabove.

Figure 16:
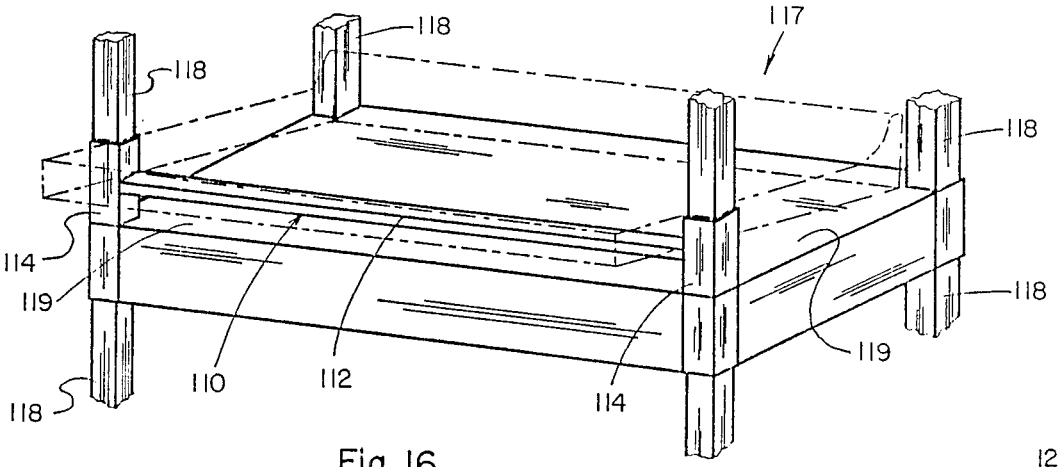
FIG. 16 is a partial perspective view of a known modular display unit showing use of the gravity feed conversion member of FIG. 15 in conjunction with a substantially flat horizontal shelf member for converting said display unit into a gravity feed system.
Figure 15:
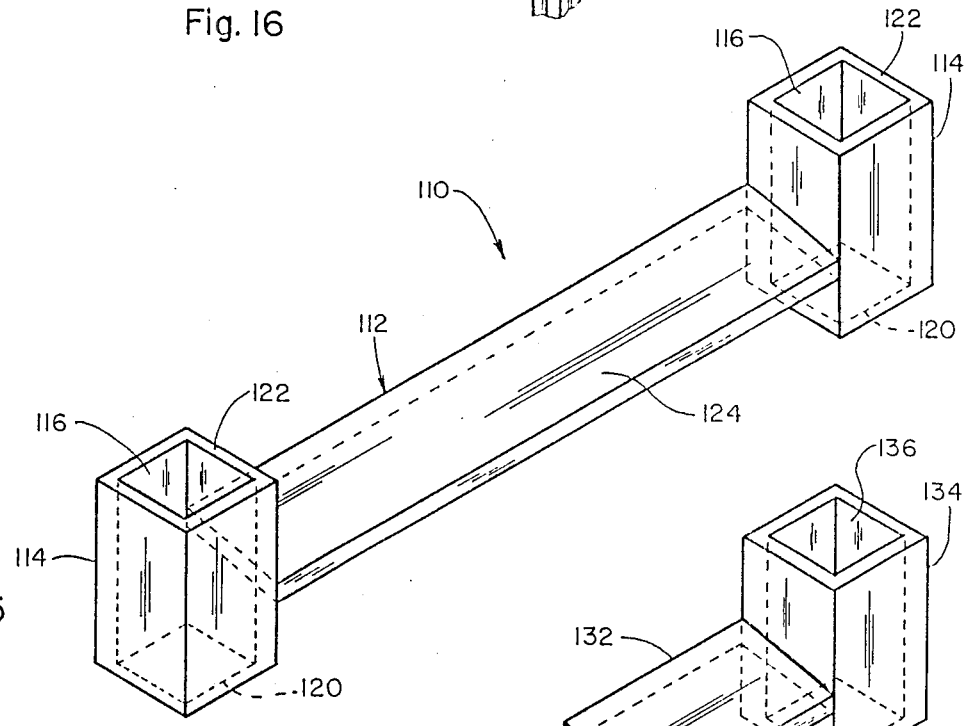
FIGS. 15 and 17 are perspective views of still other gravity feed conversion members which can be used in conjunction with known display systems for converting such systems to a gravity feed operation.

Still other means for elevating the rear portion of substantially flat shelf members used in conjunction with known modular display units include the use of another embodiment of a bar type member having sleeve or collar means associated therewith such as the bar member 110 illustrated in FIGS. 15 and 16. The bar member 110 includes a transverse member 112 having sleeve or collar means 114 associated with each opposite end thereof, each sleeve member 114 including an aperture or bore 116 extending therethrough. The aperture 116 is shaped and dimensioned so as to correspond to the cross-sectional shape and dimensions associated with the upright support members of a particular modular display system such as the upright support members 118 associated with the display unit 117 illustrated in FIG. 16. The sleeve members 114 are therefore designed to cooperatively receive the individual support members 118 through the respective apertures 116 and, when engaged with the two rear support members associated with a particular modular display unit, the bar member 110 can be slidably positioned on the respective rear support members to a predetermined location above a particular shelf display area such as the display area 119 associated with the unit 117 (FIG. 16). The position and height of the tranverse member 112 across the rear portion of each particular display area imparts the desired inclination to such additional shelf member for a gravity feed operation. When engaged with tne respective rear upright support members 118, it is preferred that the bottom wall portion 120 (FIG. 15) associated with each sleeve member 114 mate flush with and rest upon the particular shelf display area. The transverse member 112 can therefore be positioned and located intermediate the bottom and top sleeve surfaces 120 and 122 respectively so as to achieve the desired inclination to be imparted to the shelf member positioned thereon. It is recognized that the positioning of the transverse member 112 between the respective top and bottom sleeve surfaces can be made adjustable so that merchants will have the ability to vary the desired inclination for gravity feed operations depending upon the particular nature of the goods to be merchandised from such unit. Any suitable adjustment means can be utilized for varying the position of the transverse member 112 relative to the sleeve members 114 such as a groove and slot arrangement or other adjustment means commonly utilized in the shelving industry.

The sleeve members 114 may also include means for holding such members at a particular location intermediate the opposite end portions of the rear support members such that the member 112 may be vertically adjusted up or down to again vary the angle of inclination if so desired. Such means could take the form of a plurality of screws positioned and located about the periphery of each sleeve member 114 in positions to threadingly engage the upright support member extending therethrough when desired so as to hold the bar member 110 in a fixed position above the rear portion of the shelf display area. It is also recognized that the upper surface 124 of the transverse member 112 may be inclined similar to the surface 68 associated with the member 66 (FIG. 6) so as to mate flush with the rear underside portion of the shelf member positioned thereabove at the desired inclination for a gravity feed operation. It is further recognized that both the size and shape of the sleeve members 114 as well as the size and shape of the apertures 116 extending therethrough may be fashioned into a variety of different sizes and shapes, for example, triangular, circular, rectangular, square, L-shaped, hexagonal, or some other configuration, without impairing the teachings of the present invention so long as the apertures 116 are adapted to conform with and receive the particular upright support members associated with the display unit to be converted into a gravity feed operation. The bar member 110 may also be designed so that the bottom sleeve surfaces 120 will rest upon and be adequately supported by any side and/or rear wall portions associated with the particular display unit.

Figure 17:
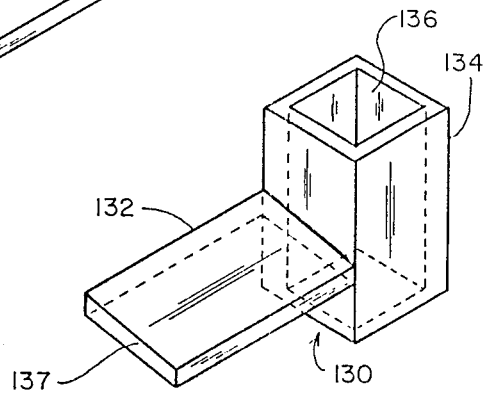
Figure 17:
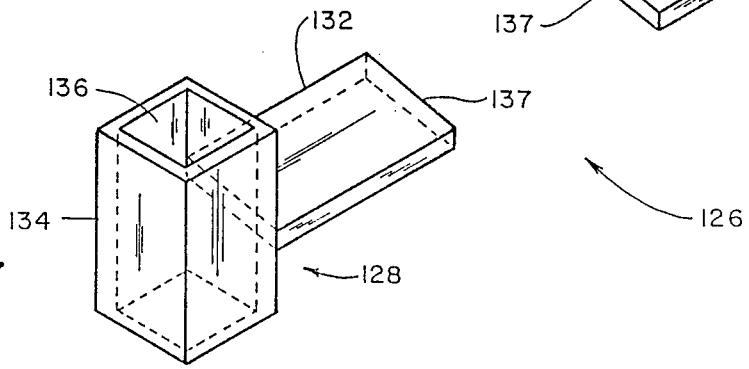

Another embodiment 126 of the bar conversion unit 110 is illustrated in FIG. 17. The embodiment 126 includes a pair of assemblies or gravity feed conversion members 128 and 130, each of which assemblies include a transverse member 132 and a sleeve member 134 attached to one opposite end portion thereof as shown in FIG. 17. The sleeve members 134 are substantially similar in construction and operation to the sleeve members 114 and each includes an aperture 136 extending completely therethrough. The transverse members 132 are likewise substantially similar in construction and operation to the transverse member 112 shown in FIG. 15 but differ therefrom mainly in that the members 132 are substantially shorter in length as compared to the member 112. The assembly 128 is designed to cooperatively receive one of the rear support members associated with a particular modular display unit while the other assembly 130 is designed to receive the other rear support member associated with the same display unit. The members 128 and 130 are respectively positioned in spaced relationship to each other on the rear support members such that the free end portions 137 of the respective transverse members 132 extend toward each other. The transverse members 132 are designed to hold and support a substantially flat shelf member in an elevated position above the particular modular display area at the rear corner portions thereof thereby imparting the desired inclination to such shelf member when positioned across the members 132. It is recognized that the length of the transverse members 132 can be varied depending upon the amount of support necessary to adequately support the weight capacity of the particular goods to be arranged thereabove.

Both gravity feed conversion means 110 and 126 require at least partial disassembly of the particular modular display unit upon which they will be assembled since the respective sleeve members 114 and 134 must be slidably engaged with the rear support members associated with the particular display area to be converted to a gravity feed operation. Because of its two piece construction, the gravity feed conversion means 126 is somewhat easier to handle and manipulate when engaging the sleeve members 134 with the appropriate upright support members. Like the embodiment 110, the tranverse members 132 as well as the sleeve members 134 may likewise include adjustable means as previously explained with respect to the members 112 and 114 shown in FIG. 15.

The various gravity feed conversion members 70, 92, 110 and 126 of the present invention greatly facilitate the conversion of conventional flat shelving structures utilized with many known product merchandising display units into gravity feed devices and also greatly increase the saleability of the products positioned thereon. These members are likewise preferably made of a plastic material, although it is recognized that various other acceptable materials of construction such as certain metals, metal alloys, fiberglass or even wood could equally be utilized to make the members 70, 92, 110 and 126.

Figure 18:
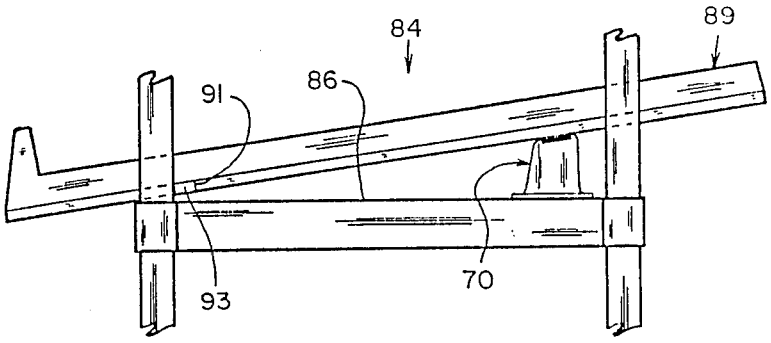
FIGS. 18 and 19 are partial perspective views of a known modular display unit showig use of the pedestal member of FIG. 9 in conjunction with another embodiment of a substantially flat shelf member for converting said display unit to a gravity feed system.
Figure 19:
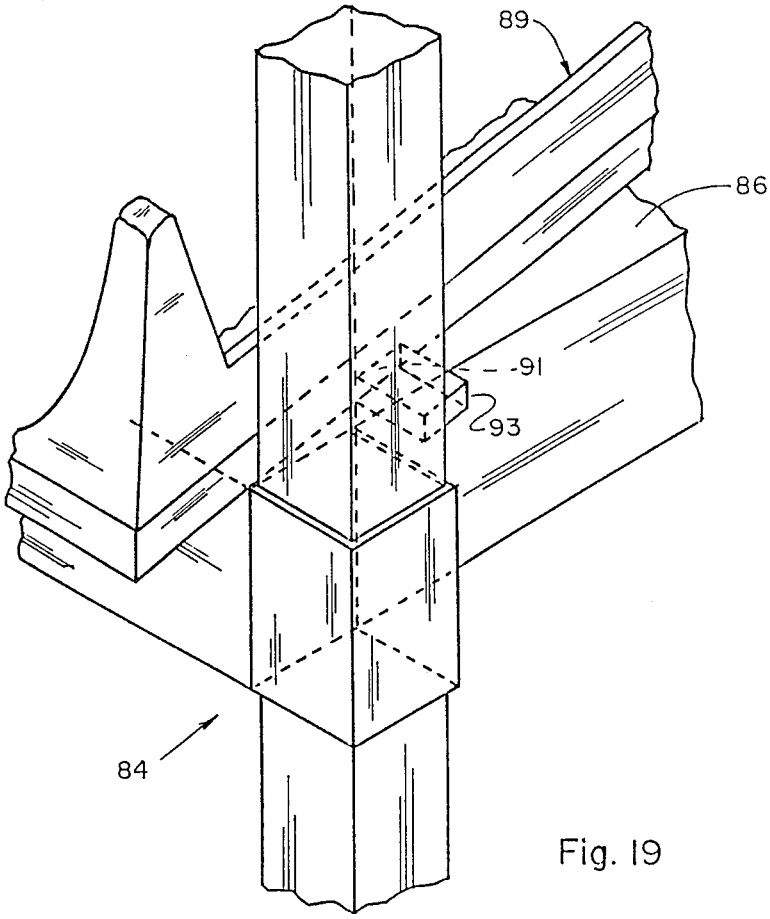

FIGS. 18 and 19 illustrate use of one of the gravity feed conversion members such as the pedestal member 70 in conjunction with the non-gravity feed type display unit 84 wherein another embodiment 89 of a substantially flat shelf member is positioned within each display area 86. The shelf member 89 differs from the shelf member 88 in that it includes an elongated channel means 91 extending transversely across the lower portion of the shelf member 89 as shown in FIGS. 18 and 19. The channel means 91 extends in spaced parallel relationship to the front wall portion of the shelf 89 and is shaped and dimensioned to cooperatively receive and hold at least one end portion of an extension member such as the member 93 (FIGS. 18 and 19). The extension member 93 is insertably positioned within the channel means 91 such that portions thereof extend beyond the periphery of the respective side walls of the shelf 89 as best shown in FIG. 19. Since the overall depth of the shelf 89 is greater than the depthwise dimension of the display area 86 (FIG. 18), the shelf 89 may be positioned as shown in FIGS. 18 and 19 with the front and rear portions thereof extending beyond the respective front and rear portions of the display area 86 and the exposed end portions of the extension member 93 engaging the respective front upright support members associated with the display unit 84. When so positioned, the exposed end portions of the extension member 93 serve as stop means and prevent the shelf member 89 from sliding forward out of the display area 86 when the rear portion thereof is elevated by any one of the gravity feed conversion members disclosed herein and products are positioned thereon.

It is recognized that the channel means 91 may be open-ended and extend widthwise across the entire shelf 89 and, in this event, a single extension member 93 may be insertably positioned therewithin such that the respective opposite end portions thereof extend beyond the respective side wall peripheries of the shelf 89 as previously explained. It is also recognized that a pair of channel means 91 may likewise be utilized with the shelf member 89, one channel means extending transversely inwardly from one side of the shelf 89 across a portion thereof and the other channel means being similarly located in opposed relationship extending transversely inwardly across a portion thereof from the opposite side of the shelf 89. In this particular situation, a pair of extension members 93 must be utilized to achieve the arrangement illustrated in FIG. 18, one extension member 93 being cooperatively engageable with one of the pair of channel means 91 and the other extension member 93 being cooperatively engageable with the other of the pair of channel means. Similarly, a pair of extension members 93 may likewise be utilized when a single channel means 91 is utilized with the shelf member 89 extending transversely across the entire portion thereof. Typical of the shelf member 89 are the shelf members disclosed in U.S. patent application Ser. No. 907,056, filed Sept. 12, 1986 and assigned to the present assignee. The shelf member 89 and the display arrangement shown in FIGS. 18 and 19 may also be utilized with all of the other gravity feed conversion members 92, 110 and 126 of the present invention.

Figure 20:
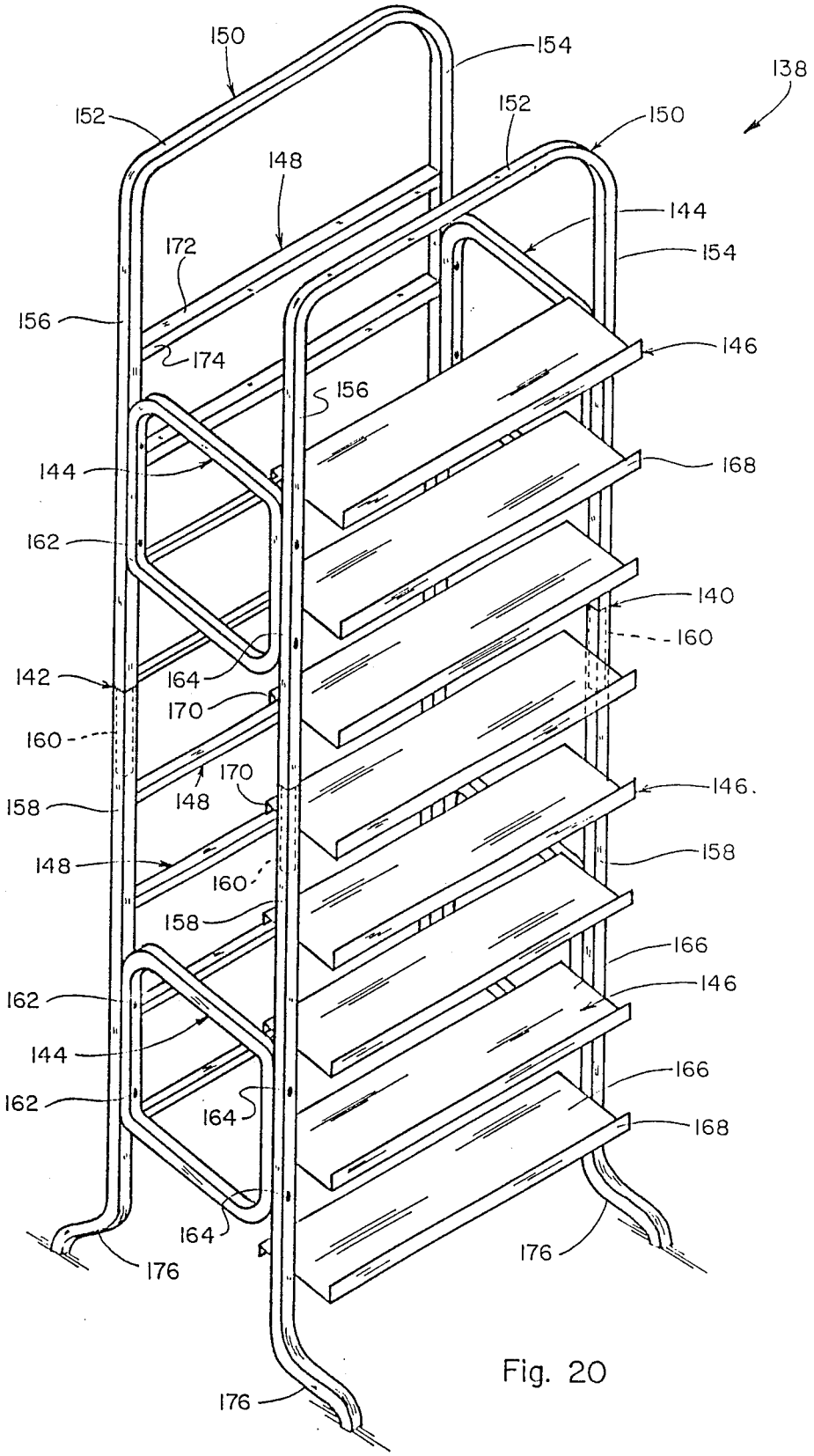
FIG. 20 is a perspective view of another embodiment of a gravity feed display system constructed according to the teachings of the present invention.

FIG. 20 illustrates another embodiment of a gravity feed display system constructed according to the teachings of the present invention. The multi-shelf gravity feed unit 138 includes a front frame support structure 140, a rear frame support structure 142, a plurality of side support members 144, a plurality of front shelf support members 146, and a plurality of rear shelf support members 148. The front and rear frame support structures 140 and 142 are substantially identical in construction and each is comprised of a substantially U-shaped upper support frame member 150 and a pair of lower support leg frame members 158. The U-shaped frame member 150 includes a cross portion 152 having a pair of spaced parallel or substantially parallel frame members 154 and 156 extending downwardly therefrom from the opposite ends of the cross portion 152 as shown in FIG. 20. The member 150 is preferably of a one-piece construction and each frame member 154 and 156 respectively includes a tapered or narrowed-down end portion 160 shown in dotted outline form in FIG. 20, the tapered end portions 160 being adapted for telescoping into the upper portion of the support leg members 158. In this regard, the upper end portion of each respective leg member 158 includes an opening or cavity dimensioned so as to telescopingly receive the tapered end portions 160 associated with the frame members 150. The members 150 and 158 are preferably made from a metal or other durable material such as certain metal alloys and such members can likewise be tubular in structure. The tapered frame end portions 160 can likewise be integrally formed with the respective frame members 154 and 156 or, if the members 154 and 156 are tubular in structure, the end portions 160 may comprise an additional tubular shaped member of somewhat smaller dimensions having a portion thereof inserted within the respective free end portions of the members 154 and 156. Any other suitable means for attaching the tapered members 160 to the free end portion of the respective members 154 and 156 may be utilized. It is anticipated that the front and rear frame support structures 140 and 142 may also be constructed as a one-piece unit.

Figure 21:
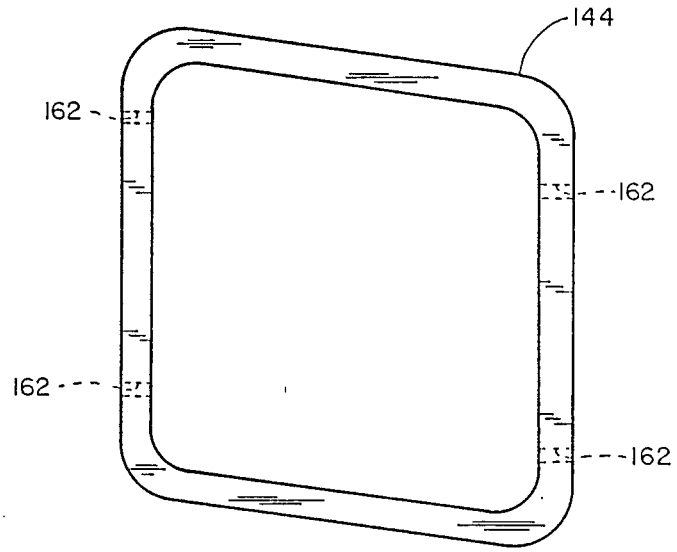
FIG. 21 is a side elevational view of one of the side support members associated with the display system of FIG. 20.
Figure 25:
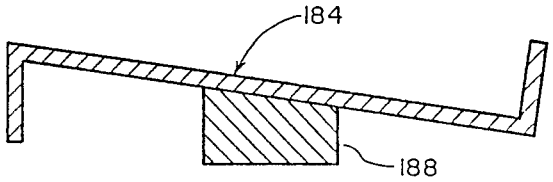
FIG. 25 is a cross-sectional view taken along line 25—25 in FIG. 24.

The front and rear frame support structures 140 and 142 are fixedly held in spaced apart relationship to each other by use of the side frame members 144 which are positioned intermediate the top and bottom portion of the overall unit 138 on each opposite side thereof as shown in FIG. 20. The side members 144 are shaped as shown in FIG. 21 and are likewise preferably integrally casted from metal or some other durable material such as certain metal alloys. Apertures 162 (FIG. 21) are located on the front and rear portions of each member 144 in positions to register with corresponding apertures 164 (FIG. 20) located on the front and rear frame support structures 140 and 142 for fixedly attaching the same to the members 140 and 142. Any suitable fastening means such as a nut and bolt arrangement may be inserted through the respective apertures 162 and 164 for completing the joinder of the members 140, 142 and 144. Any plurality of side frame members 144 may be utilized on each opposite side of the overall unit 138 depending upon the stability and rigidity desired. It is preferred that at least one side member 144 be positioned between the upper frame portions 150 and at least one side member 144 be positioned between the lower support leg members 158 as shown in FIG. 20. Although a specific shape of the side frame members 144 is depicted in FIG. 21, it is recognized that both the size and shape of the members 144 may be fashioned into a variety of different sizes and shapes without impairing the teachings of the present invention.

Figure 22:
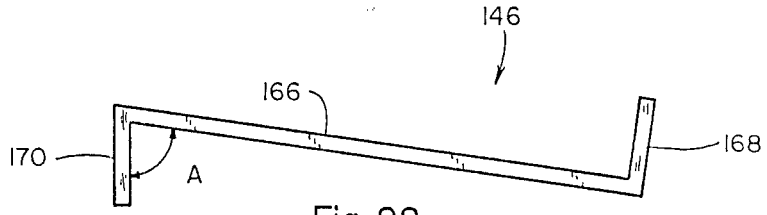
FIG. 22 is a side elevational view of one of the front shelf support members associated with the display system of FIG. 20.

Each of the front shelf support members 146 includes a floor portion 166, a front flange portion 168, and a rear flange portion 170 as shown in FIG. 22. The front flange 168 extends upwardly from the forward end portion of the floor 166 and forms a front wall or forward stop means while the rear flange 170 is angularly related to the floor portion 166 and extends downwardly therefrom. The front shelf support members 146 are positioned and attached at spaced locations to the front frame support structure 140 between the opposed upright frame members 154, 156 and 158 such that the rear flanges 170 associated respectively therewith extend in a direction substantially parallel to the members 154, 156 and 158 and substantially vertical to the horizontal support surface upon which the entire unit 138 rests. When the front support shelf members 146 are so positioned, the floor portions 166 are inclined forwardly in parallel relationship towards the front flange 168 as shown in FIGS. 20 and 22. The inclination of the floor surfaces 166 is determined by the angular displacement A (FIG. 22) between the floor portion 166 and the rear flange member 170 when the flange members 170 are oriented parallel to the members 154, 156 and 158 and this angle should be such as to produce the desired floor inclination for a gravity feed operation.

Figure 23:
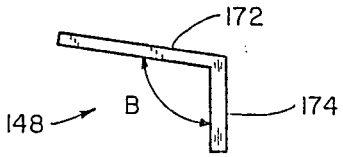
FIG. 23 is a side elevational view of one of the rear shelf support members associated with the display system of FIG. 20.

Each of the rear shelf support members 148 includes a floor portion 172 and a downwardly extending angularly related front flange portion 174 as best illustrated in FIG. 23. Similar to the positioning of the front shelf support members 146, the rear shelf support members 148 are positioned and attached in spaced apart relationship between the opposed upright frame members 154, 156 and 158 associated with the rear frame support structure 142 as shown in FIG. 20. The rear shelf support members 148 are similarly attached to the rear frame support structure 142 such that the front flange portions 174 extend in a direction substantially parallel to the frame members 154, 156 and 158 and substantially vertical to the horizontal support surface upon which the entire unit 138 rests. When so positioned, the floor portions 172 are likewise inclined forwardly in parallel relationship towards the flange member 174 (FIG. 23). The inclination of the floor portions 172 is similarly determined by the angular displacement B (FIG. 23) between the floor 172 and the downwardly extending flange 174 when the flanges 174 are oriented parallel to the members 154, 156 and 158 and this angle should likewise be such as to produce the desired floor inclination for a gravity feed operation. The inclination of the floor surfaces 166 and 172 should be identical and the rear shelf support members 148 should be located on the rear frame support structure 142 and aligned relative to the front shelf support members 146 such that the respective floor surfaces 166 and 172 lie in the same plane. This enables an additional flat shelf member to be positioned upon a respective pair of front and rear shelf support members 146 and 148 and to be inclined forwardly in a gravity feed orientation. The sum of the angles A and B will equal 180° ($A+B=180°$) if the inclination of the floor surfaces 166 and 172 are identical. The shelf support members 146 and 148 are preferably integrally formed into a one-piece construction and are preferably attached to the respective frame members 154, 156 and 158 by welding the same thereto. Many other means for attaching the members 146 and 148 to the front and rear structures 140 and 142 may be utilized.

When fully assembled, the multi-shelf gravity feed unit 138 allows a merchant to pre-position non-gravity feed type shelving devices upon the respective front and rear shelf support members 146 and 148 thereby inclining such shelf units for gravity feed operation. Since both the front and rear portions of the display unit 138 are substantially open, access to each respective pair of shelf support members 146 and 148 is less restrictive than many of the known devices which have upstanding rails and walls which makes access more difficult. A wide variety of known non-gravity feed type shelving devices can therefore be positioned upon the respective shelf support members to easily convert such devices into a gravity feed operation. When so positioned, the front flange member 168 serves as a stop means for holding and retaining such shelf devices in proper position upon the members 146 and 148. It is recognized that the depth of the floor portions 166 and 172 may be varied to accommodate any particular shelving device positioned thereon depending upon the weight capacity of the particular goods to be displayed therein. It is also recognized that the shelf support members 146 and 148 can be made of a one-piece construction or the members 146 and 148 can be replaced by a one-piece shelf support member having a floor portion extending the full length and width between the front and rear frame support structures 140 and 142. In order to improve the stability and rigidity of the unit 138, the lower end portion 176 of each support leg frame member 158 may be shaped and curved as shown in FIG. 20 so as to form a more stable footing for supporting the products positioned within the unit 138. Configurations other than the shape of the leg footings 176 are also anticipated.

Figure 24:
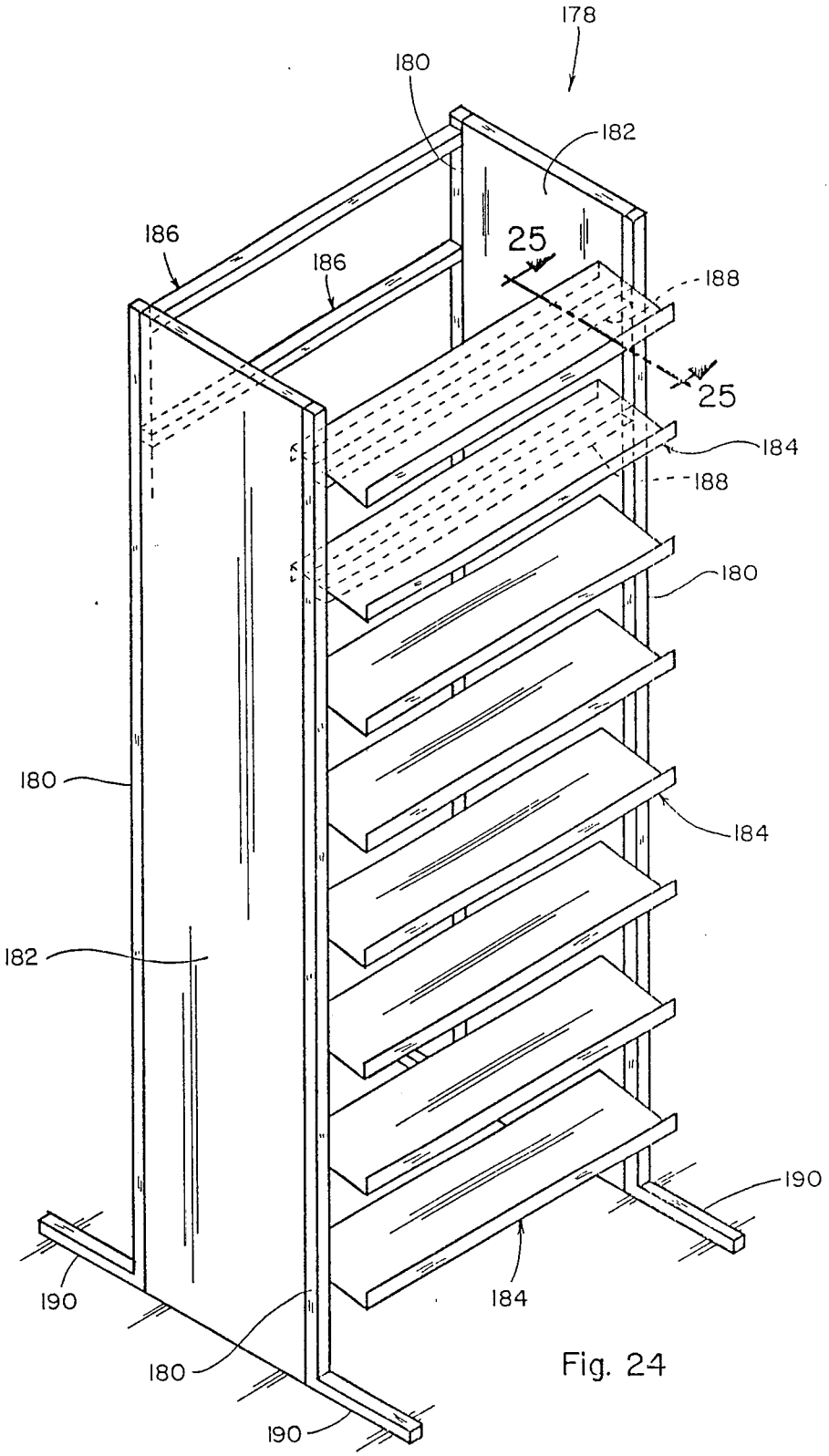
FIG. 24 is a perspective view of still another embodiment of a gravity feed display system constructed according to the teachings of the present invention.

FIG. 24 illustrates still another embodiment of a gravity feed display system constructed according to the teachings of the present invention. The multi-shelf gravity feed unit 178 is constructed somewhat similar to the display unit 138 shown in FIGS. 20–23 but differs therefrom in several important respects. The display unit 178 includes a plurality of upright support member 180, a pair of side panels 182, a plurality of front shelf support members 184, and a plurality of rear shelf members 186. The upright support members 180 are arranged in spaced apart relationship as shown in FIG. 24. More particularly, the corresponding front and rear support members 180 associated with each respective side of the unit 178 are fixedly held in spaced apart relationship to each other by use of the side panels 182 which are positioned and attached therebetween by any suitable means as shown in FIG. 24. The side panels 182 are shaped as shown in FIG. 24 and extend approximately the full length and width of the space defined between the corresponding front and rear support members 180. The side panels 182 can be made from any suitable material such as paper, board, plastic and/or metal type materials. Although a specific size and shape of the side panels 182 are depicted in FIG. 24, it is recognized that both the size and shape of the panels 182 may be fashioned into a variety of different sizes and shaped without impairing the teachings of the present invention. It is also recognized that smaller side panels may likewise be utilized with the display unit 178 and any plurality of such smaller side panels may be fixedly attached to the corresponding front and rear support members 180 by any suitable fastening means.

The front and rear shelf support members 184 and 186 are constructed substantially similar to the front and rear support members 146 and 148 previously described with respect to the display unit 138 (FIGS. 20–23). Similarly, the front and rear shelf support members 184 and 186 are positioned and attached at spaced locations between the respective front and rear support members 180 in a similar manner as previously described with respect to the display unit 138 (FIGS. 20 and 23). Like the floor surfaces associated with the front and rear shelf support members 146 and 148 associated with the display unit 138, the inclination of the floor surfaces associated with the front and rear shelf support members 184 and 186 should be so similarly aligned relative to each other that the respective floor surfaces lie in the same plane. This again enables an additional flat shelf member to be positioned upon a respective pair of front and rear shelf support members 184 and 186 and to be inclined forwardly in a gravity feed orientation.

An additional transverse support member 188 extends between the pair of front opposed upright support members 180 and beneath each respective front shelf support member 184 to provide additional support and stability to the shelf support member 184, the additional flat shelf member positioned upon the respective pairs of shelf support members 184 and 186, and the overall unit 178. The transverse member 188 may be fixedly attached between the front support members 180 by any suitable means. In addition, the lower end portion of each of the upright support members 180 includes a leg or footing member 190 (FIG. 24) for maintaining the overall unit 178 in a stable upright position during use. The leg footings 190 extend substantially perpendicular to the respective front and rear support members 180 as shown in FIG. 24 and each lies substantially flush with the supporting surface upon which the display unit 178 rests. Configurations other than the shape and dimension of the leg footings 190 shown in FIG. 24 are also anticipated. It is also anticipated that signage and other advertising material may be associated with the respective side panels 182 and it is further recognized that a header display may likewise be associated with the upper portion of the display unit 178 as well as the display unit 138.

Although it is recognized that various accepted materials of construction are available and could equally be employed to fabricate the various components of the display units 138 and 178, it is usually preferred that such components be casted from certain metals or other durable materials such as certain other metal alloys which are able to withstand moderate impact and mishandling and supply the necessary strength and rigidity depending upon the particular application and the load carrying capacity desired. It is also recognized that certain relatively strong plastic materials as well as other types of materials may likewise be used in fabricating some, if not all, of the components of the units 138 and 178 so long as such materials are able to withstand the desired load carrying capacity of such units.

It is also important to note that the overall dimensions of the display units 138 and 178 as well as the configuration of the front and rear frame support structures 140 and 142, the side support members 144, the front and rear shelf support members 146, 148, 184 and 186, the support members 180, and the side panels 182 are subject to wide variations and may be sized and shaped into a variety of different sizes and configurations so as to be compatible with the size and shape of the additional shelf devices which may be used in conjunction therewith, or to conform with any other space limitation, without impairing the teachings and practice of the present construction.

Thus, there has been shown and described several gravity feed display systems as well as several gravity feed conversion means for converting existing display units to gravity feed type systems, which display systems and conversion means for obtaining the same fulfill all of the objects and advantages sought therefor. Many changes, modifications, variations, and other uses and applications of the present constructions will, however, become apparent to those skilled in the art after considering this specification and the accompanying drawings. All such changes, modifications, variations, and other uses and applications which do not depart from the spirit and scope of the invention are deemed to be covered by the invention which is limited only by the claims which follow.

What is claimed is:

1. A modular display unit for vertically stackably arranging products in inclined gravity feed orientation comprising a plurality of substantially similar shelf members each having opposed side wall portions and a planar floor portion extending therebetween on which products are positioned cooperatively engageable means located at spaced locations on each of said shelf members adjacent said opposed side wall portions, each of said cooperatively engageable means having a locating surface oriented at the same acute angle relative to the plane of said floor portions, a plurality of elognated support members each having opposed end portions engageable at each opposite end thereof with a respective locating surface associated with the cooperatively engageable means on adjacent shelf members to connect said adjacent shelf members in spaced apart relationship, and means for supporting said connected shelf members on a horizontal surface with said support members oriented in a vertical direction, the cooperatively engageable means associated with one of the side wall portions of each of said shelf members being arranged in opposed relationship to the cooperatively engageable means associated with the other of the side wall portions of each of said shelf members, each opposed pair of cooperatively engageable means having an elongated transverse member extending therebetween, said transverse member extending across the underside portion of each of said shelf members between said opposed side wall portions.

2. The display unit of claim 1 wherein said means for supporting said connected shelf members on a horizontal surface includes a plurality of base support members engageable with the locating surface of said cooperatively engageable means associated with one of said plurality of shelf members, said base support members being dimensioned so as to maintain said shelf members in parallel inclined gravity feed orientation.

3. The display unit of claim 1 including a cavity associated with each of said cooperatively engageable means, said cavity being formed in part by said locating surface, said cavity being adapted for receiving one of the opposed end portions of said elongated support members.

4. The display unit of claim 1 including a projection member associated with each of said cooperatively engageable means, said projection member being formed in part by said locating surface, each of said elongated support members including means for receiving said projection member.

5. The display unit of claim 1 wherein said elongated support members are substantially rectangular in cross-section.

6. The display unit of claim 1 wherein said elongated support members are substantially square in cross-section.

7. The display unit of claim 1 wherein said elongated support members are tubular in shape.

8. A gravity feed display unit for stackably arrnaging products thereon comprising a plurality of shelf members each having opposed side wall portions and a planar floor portion extending therebetween, socket means associated with each of said shelf members at spaced locations thereon adjacent said opposed side wall portions, each of said socket means having first and second opposed end portions, first and second cavities extending respectively from the first and second end portions of each of said socket means, each of said cavities having a surface portion oriented at the same acute angle relative to the plane of said floor portions, a plurality of elongated suppport members each having opposed end portions adapted to cooperate with corresponding opposed cavities associated with the socket means on adjacent shelf members to connect said adjacent shelf members in spaced apart relationship, and means for supporting said connected shelf members on a horizontal surface with said support members oriented in a vertical direction, the socket means associated with one of the side wall portions of each of said shelf members being arranged in opposed relationship to the socket means associated with the other of the side wall portions of each of said shelf members, each opposed pair of socket means having an elongated transverse member extending therebetween, said transverse member extending across the underside portion of each of said shelf members between said opposed side wall portions.

9. The display unit of claim 8 wherein each of said first and second cavities are axially positioned in alignment with each other.

10. The display unit of claim 9 wherein each of said first cavities extend from the respective first end portions of said socket means so as to communicate with each of said second cavities thereby forming a single bore through each of said socket means, each of said bores being adapted at each opposite end thereof for cooperatively engaging the opposed end portions of said elongated support members.

11. The display unit of claim 8 wherein said transverse member includes an inclined top surface.

12. The display unit of claim 8 wherein said means for supporting said connected shelf members on a horizontal surface includes a plurality of base support members engageable with at least some of the socket means associated with one of said plurality of shelf members, said base support members being dimensioned so as to maintain said shelf members in parallel inclined gravity feed orientation.

13. The display unit of claim 13 including a base stand having a substantially flat base member and a plurality of receiving means extending upwardly therefrom, each of said receiving means being cooperatively engageable with said base support members, said receiving means being positioned and arranged on said flat base member so as to register with the position and location of said base support members when said base support members are engaged with said one of said plurality of shelf members.

14. The display unit of claim 13 including a base stand having a substantially flat base member and a single receiving means extending upwardly therefrom, said receiving means being cooperatively engageable with any one of said base support members.

* * * * *

UNITED STATES PATENT OFFICE

CERTIFICATE OF CORRECTION

Patent No. 4,763,796 Dated August 16, 1988

Inventor(s) Paul L. Flum

It is certified that error appears in the above-identified patent and that said Letters Patent are hereby corrected as shown below:

Column 4, line 64, after "in" insert --conjunction--.

Column 13, line 24, "tne" should be --the--.

Column 21, line 6, "arrnaging" should be --arranging--.

Column 22, line 22, "claim 13" should be --claim 8--.

Signed and Sealed this

Third Day of January, 1989

*Attest:*

DONALD J. QUIGG

*Attesting Officer*

*Commissioner of Patents and Trademarks*